US007204262B2

(12) United States Patent
DeMay et al.

(10) Patent No.: US 7,204,262 B2
(45) Date of Patent: Apr. 17, 2007

(54) FOREARM CRUTCH PADDED COVER

(75) Inventors: Shirley DeMay, St. Louis, MO (US); Neil Westbrooks, St. Louis, MO (US)

(73) Assignee: DeMay Med, LLC, St. Louis, MO (US)

( * ) Notice: Subject to any disclaimer, the term of this patent is extended or adjusted under 35 U.S.C. 154(b) by 125 days.

(21) Appl. No.: 10/928,901

(22) Filed: Aug. 27, 2004

(65) Prior Publication Data

US 2006/0042672 A1 Mar. 2, 2006

(51) Int. Cl.
*A61H 3/02* (2006.01)

(52) U.S. Cl. ..... 135/68; 135/71; 135/72; 150/154; 280/67; 482/67; 482/75

(58) Field of Classification Search ..... 135/65, 135/68, 71–73, 907; 128/877–878; 150/154, 150/160; 224/407, 901, 901.2; 602/19–23, 602/62; 482/75–76, 66–67
See application file for complete search history.

(56) References Cited

U.S. PATENT DOCUMENTS

D258,096 S * 2/1981 Barfod ..... D3/8
4,858,267 A * 8/1989 Unger ..... 15/220.1
4,869,280 A * 9/1989 Ewing ..... 135/69
5,101,846 A * 4/1992 Greatwood ..... 135/73
5,284,194 A * 2/1994 Gaffney ..... 150/160
5,329,954 A * 7/1994 Miyoshi ..... 135/71
6,085,765 A 7/2000 Sigsworth ..... 135/68
6,129,693 A * 10/2000 Peterson ..... 602/32

FOREIGN PATENT DOCUMENTS

DE 196 24 414 A1 * 1/1988
DE 4340424 A1 * 6/1995

* cited by examiner

*Primary Examiner*—Winnie Yip
(74) *Attorney, Agent, or Firm*—Paul M. Denk

(57) ABSTRACT

A forearm crutch cover that provides padding in the forearm cradle to increase the comfort of the user and covers the pivoting attachment junction that attaches the forearm cradle to the pole of the forearm crutch to help prevent injury or damage caused at the pivoting attachment junction when the forearm cradle is moved.

14 Claims, 4 Drawing Sheets

FOREARM CRUTCH PADDED COVER

BACKGROUND OF INVENTION

This invention relates generally to padded cane or crutch coverings and cushions. More specifically, this invention relates to a padded cover or cushion for a forearm cane or crutch. A typical forearm cane or crutch consists of an adjustable length pole with a forearm cradle pivotally attached at or near the top of the pole. The cane or crutch is typically made of metal or some other sturdy material for support and durability.

During normal activities, the user can develop sores on the forearm due to pressure or pinching of the arm in the forearm cradle. In addition, the junction where the forearm cradle attaches to the crutch pole can often create discomfort and pain. For example, the user may pinch his arm between the forearm cradle and pole as the forearm cradle pivots through a range of positions. The attachment junction can also pinch or catch on materials near it and cause damage to clothing, coats, upholstery or other materials it contacts. Further, the attachment junction can scratch or mar walls, doors, trim, furniture, vehicles or the like.

What is needed, therefore, is a forearm cane or crutch covering or cushioning that makes the crutch more comfortable for the user while at the same time it helps protect the user and his surroundings from injury or damage related to relative movement between the forearm cradle and the pole on which it is mounted.

It is an object of this invention to make the forearm cradle of a forearm cane or crutch more comfortable and to minimize or eliminate pinching, scratching or other damage caused by the pivotable connection of the forearm cradle to the pole.

It is feature of this invention that the forearm cane or crutch cover will fit the forearm cane or crutch when it is adjusted to fit the height and arm length of a user.

It is another feature of the invention to make it more comfortable and to make it easier to control the operation of a cane or crutch.

It is yet another feature of the invention to make it possible to apply the teachings of the present invention to known canes or crutches to increase their comfort and to make them better able to be used.

Another feature of the invention is to make better use of commercially available canes and crutches.

Still other objects, advantages, distinctions and alternative constructions and/or combinations of the invention will become more apparent from the following description with respect to the appended drawings. Similar components and assemblies are referred to in the various drawings with similar alphanumeric reference characters. This description should not be literally construed in limitation of the invention. Rather, the invention should be interpreted within the broad scope of the further appended claims.

SUMMARY OF THE INVENTION

The present invention is directed to a forearm cane cover or cushion or a forearm crutch cover or cushion that makes the forearm cradle more comfortable for the user and helps prevent injury or damage caused by contact with the sharp edges of the pivoting attachment junction and by the resultant gap created and closed between the forearm cradle and pole when the forearm cradle pivots around the pole of the cane or crutch.

The cover may include an at least partially padded covering for the forearm cradle with pieces that may extend from the forearm cradle and may cover at least some portion of the pivoting attachment junction that connects the forearm cradle to the pole. Preferably the cover may provide padding on the inside of the forearm cradle to make the forearm cradle more comfortable to the user. Then extensions from the forearm cradle area may cover the pivoting attachment junction that connects the forearm cradle to the pole. These extensions may essentially enclose the pivoting attachment junction and the gap between the forearm cradle and pole created and closed as the forearm cradle pivots from a backward position to a forward position.

An optional feature of the present device is the use of an expandable portion in the extensions or pieces that cover at least some portion of the pivoting attachment junction. Thus when the forearm cradle pivots through its range of positions, the expansion of the expandable portion may reduce gaping or bunching in the pieces that cover at least some portion of the pivoting attachment. In addition, the expandable portion may allow a forearm crutch cover to fit a forearm crutch when adjusted to various users' heights and arm lengths.

Another optional feature includes an opening on the front extension of the cover that encompasses the handgrip. This opening may help secure the cover's attachment to the cane or crutch. Alternatively, the crutch cover may include a portion that covers the handgrip of the cane or the crutch. This opening may help secure the cover's attachment to the cane or crutch as well as increase the comfort of the handgrip.

DETAILED DESCRIPTION OF THE INVENTION

The apparatus described herein covers the top portion of a forearm cane or crutch to provide a padded forearm cradle and at least a partial enclosure for the pivoting connection junction that attaches the forearm cradle to the pole.

Figure 1:
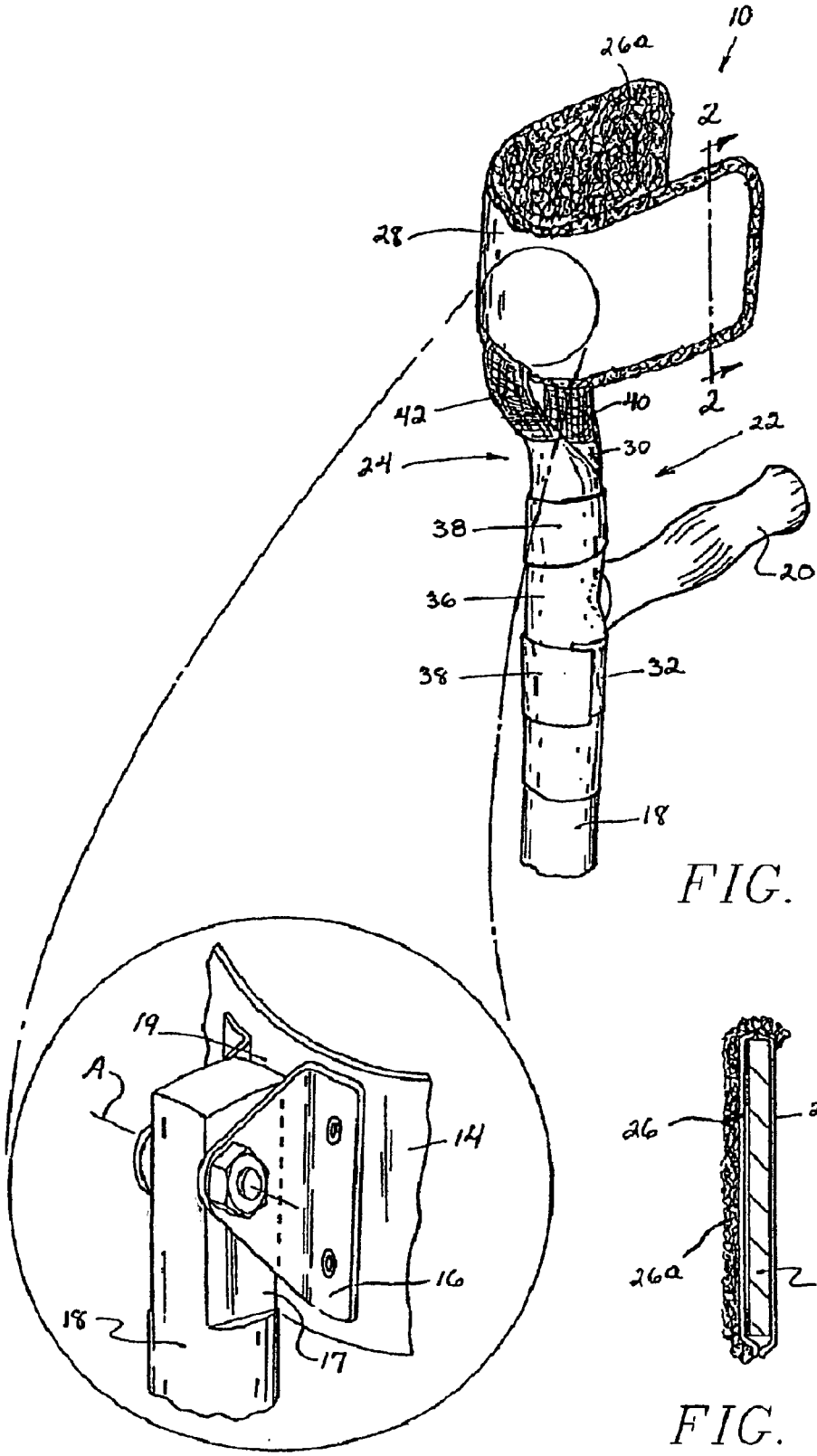
FIG. 1 is a perspective view of a preferred embodiment of the forearm crutch cover as used on a forearm crutch, and a cut away perspective view of the pivoting connection junction that connects the forearm cradle to the pole of the forearm crutch.

FIG. 1 depicts a preferred embodiment of a cover 10 for a forearm cane or forearm crutch as shown on a forearm crutch having a forearm cradle 14, a pole 18 and a handgrip 20. The pivoting attachment 16 of the forearm cradle 14 to the pole 18 is shown in the encircled portion of FIG. 1 without the cover 10. This pivoting connection 16, shown as a yoke and bolt attachment in this embodiment, could be a collar and pin joint, a hinge, a swivel, a ball and socket assembly, or the like, depending upon the particular design and construction of the forearm cane or crutch. The pivoting connection 16 allows the forearm cradle 14 to rotate about an axis A through a range of positions. When utilized, the cover 10 may fit over the forearm cradle 14, extend down the pole 18 and may cover at least a portion of the yoke and bolt attachment 16 that pivotally attaches the forearm cradle 14 to the pole 18. The front 22 of the cover 10 may be situated inside the forearm cradle 14 and may extend down the pole 18 towards the sidewardly extending handgrip 20. The back 24 of the cover 10 may be situated around the back or outside of the forearm cradle 14 and may extend down the pole 18 and may cover at least a portion of the yoke and bolt attachment 16 that attaches the forearm cradle 14 to the pole 18.

Figure 2:
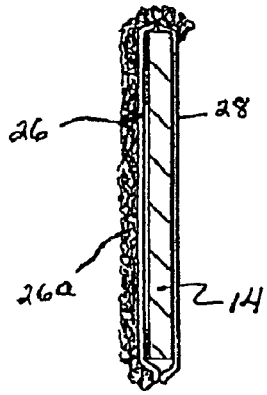
FIG. 2 is a cross-sectional view of FIG. 1 taken along the line 2—2.
Figure 3:
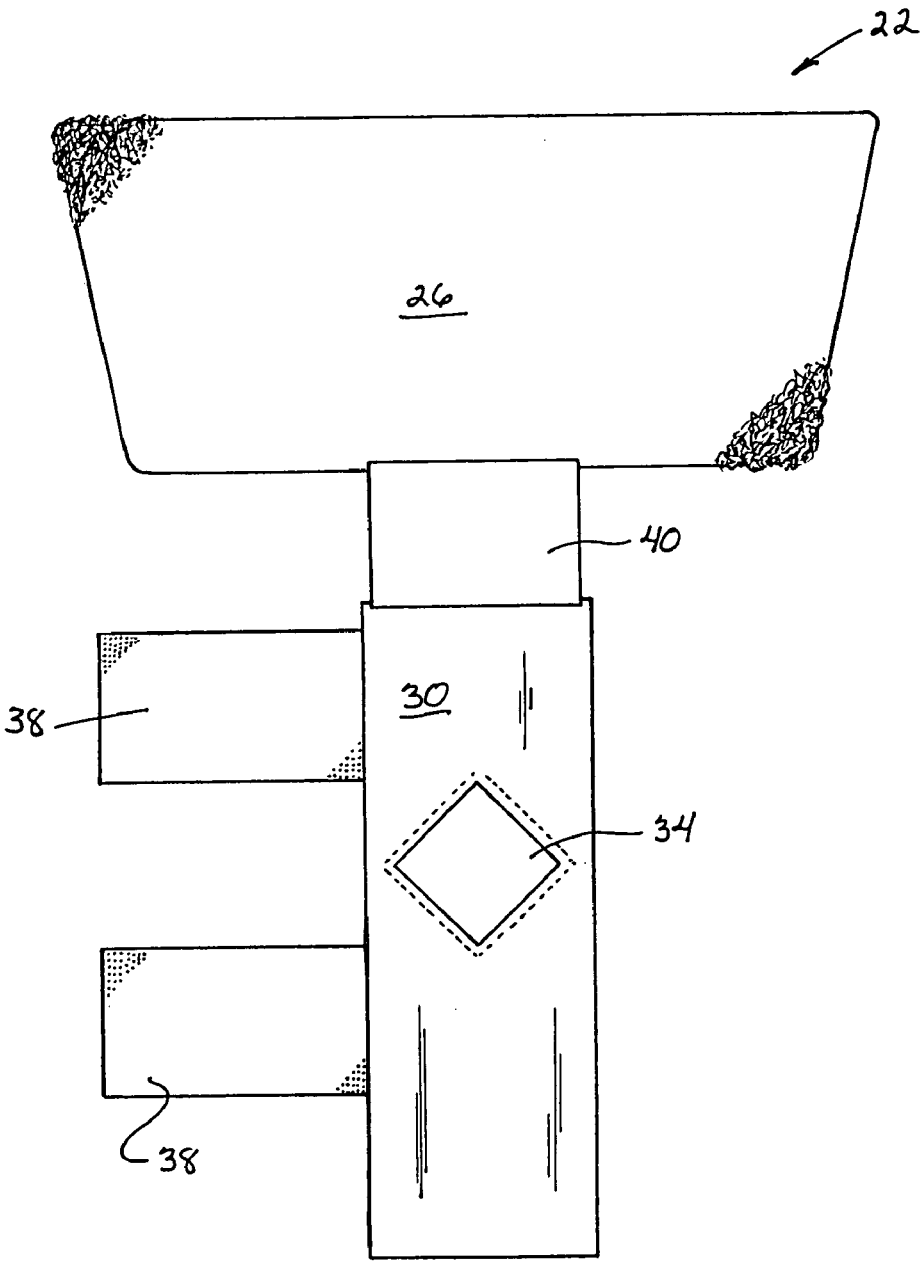
FIG. 3 is a plan view of the preferred embodiment of the forearm crutch cover as seen from the front.
Figure 4:
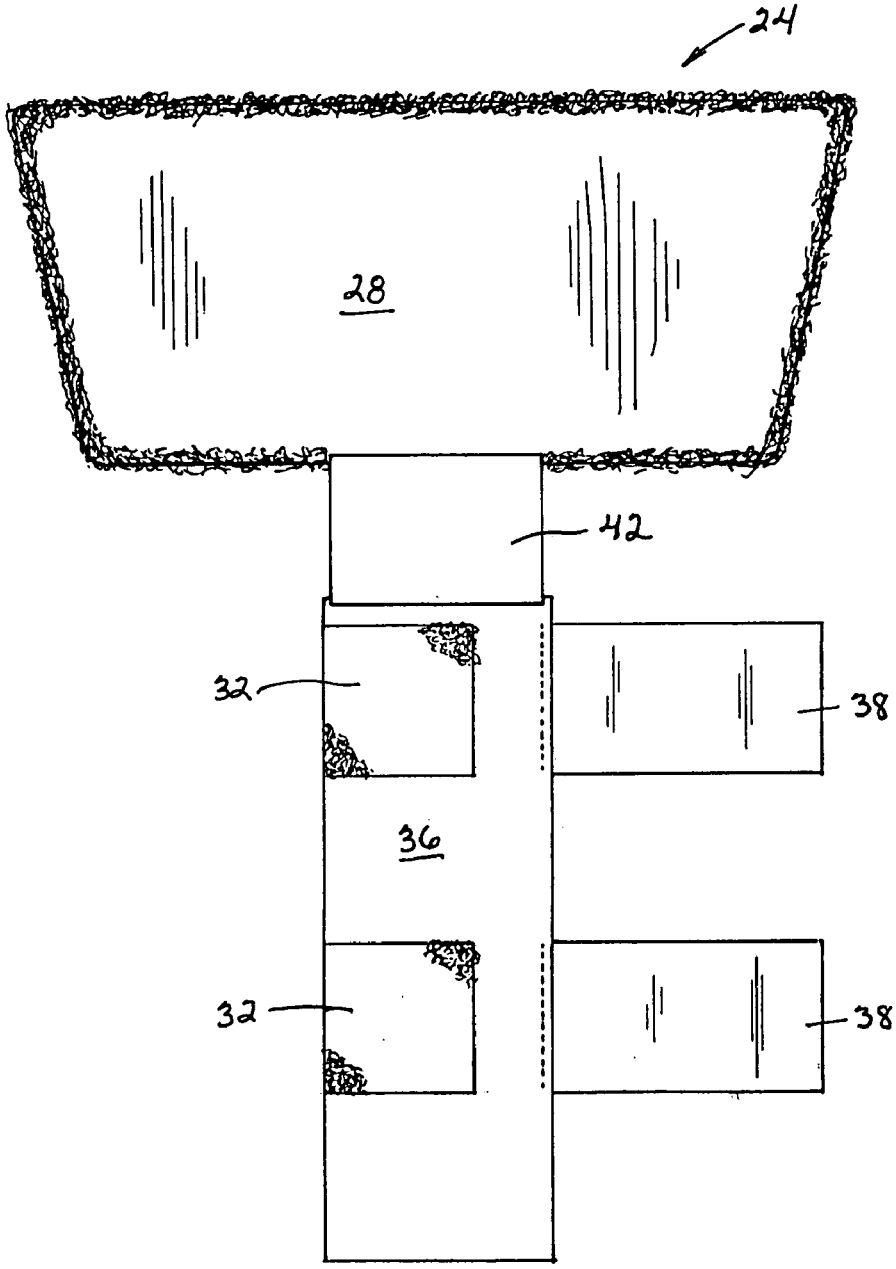
FIG. 4 is a plan view of the preferred embodiment of the forearm crutch cover as seen from the rear.

The forearm cane or crutch cover 10 may be described in four portions—the inner or front forearm cradle portion 26, the outer or back forearm cradle portion 28, the front pole portion 30 and the back pole portion 36 as seen in FIGS. 2, 3 and 4. FIG. 2 is a cross-sectional view of the cover 10 shown in FIG. 1 taken along the line 2—2. The front forearm cradle portion 26 and the back forearm cradle portion 28 are shown on either side of the forearm cradle 14.

The front and back forearm cradle position 26, 28 may form a flexible covering sized to fit over the U-shaped C-shaped forearm cradle 14. The flexible covering may be constructed in a number of ways that include, but are not limited to, sewing, hook and loop closures, mechanical fasteners, adhesives, or the like. The front and back pole portions 30, 36 may extend from the front and back forearm cradle portions 26, 28. An alternate construction of the cover may include a cushioning material 26*a* applied directly to the inner or front forearm cradle portion and one or more pole portions may extend from the inner or front forearm cradle portion.

FIG. 3 shows a plan view of the front 22 of the forearm crutch cover 10. The inner or front cradle portion 26 is usually the portion in contact with the user's arm. The padding on the front cradle portion 26 may cushion the user's arm, and it may be made from natural materials or man-made materials, such as soft plastic or rubber, leather, fur or fur-like materials, or the like. The front pole portion 30 may extend from the front forearm cradle portion 26, and it may cover at least some portion of the yoke and bolt attachment 16 that connects the forearm cradle 14 to the pole 18.

FIG. 4 depicts the back 24 of the forearm crutch cover 10. The back forearm cradle portion 28 may cover the back or the outside of the forearm cradle 14. The back cradle portion 28 may be made of natural materials or man-made materials. The back pole portion 36 may extend from the back forearm cradle portion 28, and it may cover at least some portion of the yoke and bolt attachment 16 that connects the forearm cradle 14 to the pole 18. In addition, the back pole portion 36 may have cooperatively engaging elements 32, 38 to help the forearm crutch cover 10 remain on the forearm crutch 12. The cooperatively engaging elements 32, 38 may be, but are not limited to, hook and loop closure as shown in FIG. 4, or any number of methods, such as mechanical fasteners, buckles, slide fasteners, adhesives or the like.

The front pole portion 30 shown in FIG. 3 may include an opening 34 sized to encircle the base of the handgrip 20 that may serve as an additional method to secure the forearm crutch cover 10 to the forearm crutch 12. Alternatively the front pole portion 30 may include a portion that may encase at least some portion of the handgrip 20 that may serve as an additional method to secure the forearm crutch cover 10 to the forearm crutch 12. This covering may provide a better grip for the user and it may be padded to increase the user's comfort.

Figure 6:
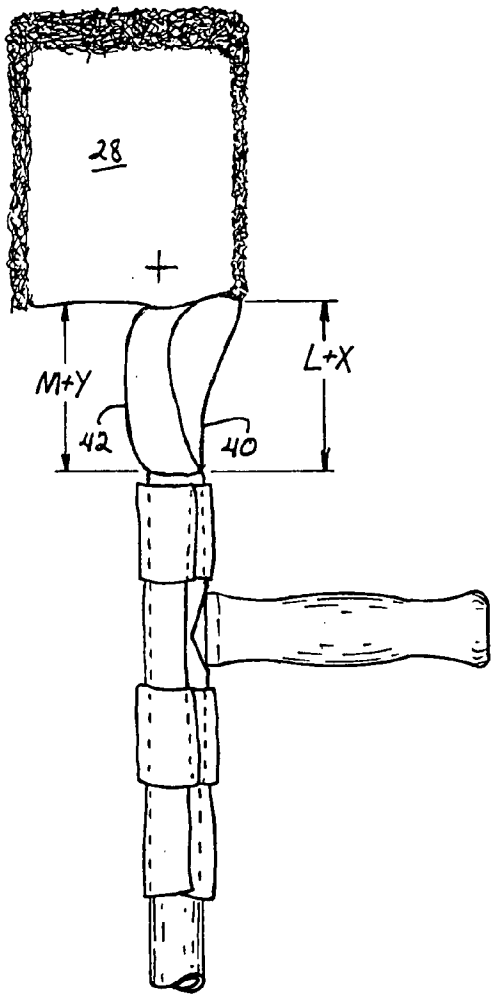
FIG. 6 is a side view of a preferred embodiment of the invention as shown on a forearm crutch with the forearm cradle rotated backward, or in a hands free position typically associated with resting.
Figure 5:
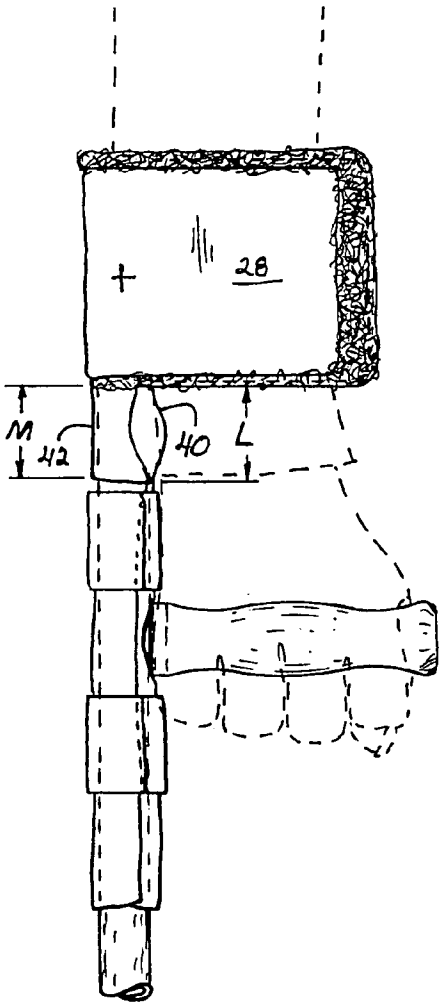
FIG. 5 is a side view of a preferred embodiment of the invention as shown on a forearm crutch with the forearm cradle rotated forward, or in a weight bearing position typically associated with walking.

The front and back pole portions 30, 36 may have an expandable portion 40, 42 at or near their connection to the front and rear cradle portions 26, 28 to provide for the increase in length that may be required in the front and back pole portions 30, 36 as the forearm cradle 14 is rotated about axis A through its range of positions. FIGS. 5 and 6 show the increase in length that may be required of the expandable portions 40, 42 when the forearm cradle 14 is rotated from a forward position as shown in FIG. 5, around axis A, to a more backward position as shown in FIG. 6. In FIG. 5, when the forearm cradle is in its generally forward or weight bearing position associated with using the forearm crutch to walk, the expandable portion 40 is shown to have length L, and the expandable portion 42 is shown to have length M. In FIG. 6, when the forearm cradle is in its generally backward or hands free position associated with using the forearm crust at rest, the expandable portion 40 is shown to have length X+L, and the expandable portion 42 is shown to have length Y+M to accommodate the increased length that may be required in the front and back pole portions 30, 36. In addition, because the typical forearm crutch is adjustable for users of various heights and arm lengths, the expandable portions 40, 42 may allow the same forearm crutch cover 10 to fit a forearm crutch at a variety of adjusted sizes.

The forearm crutch cover 10 may be made entirely of soft, flexible natural or man-made material. The use of an expandable portion 40, 42, however, allows for more freedom in selecting the material that may be used for the cover 10. With the exception of the padding for the front cradle portion 26, the forearm crutch cover 10 may be made of a harder, more durable material such as plastic, vinyl, metal or the like, or a combination of hard and soft materials, provided an expandable portion is used at some location along the forearm crutch cover 10 to allow for movement of the forearm cradle 14.

Another alternative for this invention includes a forearm crutch or cane having a forearm cradle constructed with a padded material attached to the inside of the forearm cradle. The invention could further include one or more pole portions covering at least part of the pivoting attachment junction of the forearm cradle and the pole.

This description does not intend to limit the performance of these processes and functions to only the methods described herein. Many processes can be performed in a different, but equivalent manner or order than described herein without exceeding the scope of this invention.

Although the invention has been described in terms of specific embodiments and applications, persons skilled in the art can, in light of this teaching, generate additional embodiments without exceeding the scope or departing from the spirit of the claimed invention. In addition, specific features of the invention are shown in some drawings and not in others for convenience only, as each feature may be combined with any or all of the other features in accordance with the invention. Accordingly, it is to be understood that the drawings and description in this disclosure are proffered to facilitate comprehension of the invention and should not be construed to limit the scope thereof.

What is claimed is:

1. A forearm crutch padded cover for covering a forearm cradle of a forearm crutch having a top portion of an elongate crutch pole being pivotally attached to a substantial center portion of an outer part of the forearm cradle via a pivotal connection, and a forwardly extending hand grip mounted on the pole, comprising: a cover member, said cover member including a front portion and a back portion, said front portion adapted to cover an inside of the forearm cradle, and the back portion adapted to cover the outer part of the forearm cradle and the pivotal connection between the forearm cradle and the pole such that the forearm cradle is substantially covered by the cover member, said front portion of the cover member being padded, a pole engaging portion connecting with and extending downwardly from an substantial center portion of the front portion of the cradle cover member, the pole engaging portion extending downwardly in proximity with a part of the length of the pole, at least one first engaging element connecting to a downward segment of the downwardly extending pole engaging portion and extending outward for wrapping around the contiguous pole and the pole engaging portion and fastening onto itself to secure the padded cover to the forearm crutch, whereby said padded cover covers the forearm cradle, its pivotal connection with the elongate pole, and a portion of the pole during usage.

2. The forearm crutch cover of claim 1 wherein said cover is made of flexible material.

3. The means of claim 1 wherein the flexible member is formed of a fur like material.

4. The means of claim 1 wherein the flexible member is formed of a cloth like material.

5. The forearm crutch padded cover of claim 1 and including a second pole engaging element connecting with the pole engaging portion at a location above the first pole engaging element, and there being a space between the first and second pole engaging elements for clearance for extension of the hand grip forwardly therethrough.

6. The forearm crutch padded cover of claim 5 and including a second pole engaging portion connecting with the back portion of the cover member, and extending downwardly upon the backside of the crutch pole, and said first and second pole engaging elements also wrapping around the downwardly extending back pole engaging portion when securing the padded cover to the forearm crutch.

7. The forearm crutch padded cover of claim 6 and including an expandable section provided intermediate the back portion of the cover member and the second pole engaging portion whereby movement of the forearm cradle relative to said pole causes said expandable section to contract.

8. The forearm crutch padded cover of claim 1 and including an aperture provided within the front downwardly extending pole engaging portion to provide clearance for the hand grip of the pole to extend therethrough when the padded cover is secured to the forearm crutch during usage.

9. The forearm crutch padded cover of claim 1 wherein the front portion of the cover and the back portion of the cover are integrally foldably connected at there upper edges, to provide for the cover member to drape over the forearm cradle during its application.

10. The forearm crutch padded cover of claim 1 and including an expandable section provided between the front portion of the cover member and the front pole engaging portion whereby movement of the forearm cradle relative to the pole causes an expandable section to expand.

11. The forearm crutch padded cover of claim 1 wherein the first engaging element securing the cover member to the pole includes one of a mechanical fastener, buckle, slide fastener, and hook and loop closure when securing the engaging element and the padded cover to the forearm crutch.

12. The forearm crutch padded cover of claim 1 wherein the front portion covering the inside of the forearm cradle is padded at least on some portion thereof.

13. The forearm crutch padded cover of claim 12 wherein said cover member padded portion is detachable.

14. The forearm crutch padded cover of claim 1 wherein said cover member covering the pivotal connection of the forearm cradle to the crutch pole includes a pleated portion.

* * * * *